US006188313B1

(12) United States Patent
Stahl

(10) Patent No.: US 6,188,313 B1
(45) Date of Patent: Feb. 13, 2001

(54) DEVICE FOR GENERATING SOUND

(75) Inventor: Lars Stahl, Linköping (SE)

(73) Assignee: Åm System AB, Skultuna (SE)

( * ) Notice: Under 35 U.S.C. 154(b), the term of this patent shall be extended for 0 days.

(21) Appl. No.: 09/230,123

(22) PCT Filed: Jul. 21, 1997

(86) PCT No.: PCT/SE97/01301

§ 371 Date: Oct. 13, 1999

§ 102(e) Date: Oct. 13, 1999

(87) PCT Pub. No.: WO98/03964

PCT Pub. Date: Jan. 29, 1998

(30) Foreign Application Priority Data

Jul. 22, 1996 (SE) ..... 9602851
Jan. 11, 1997 (SE) ..... 9700095

(51) Int. Cl.[7] ..... G08B 3/10

(52) U.S. Cl. ..... 340/384.73; 340/388.1; 340/388.3; 367/163; 367/168

(58) Field of Search ..... 340/384.1, 388.1, 340/388.3, 388.4, 388.5, 392.2, 384.73; 367/162, 163, 165, 174, 176, 168; 381/190, 191, 192

(56) References Cited

U.S. PATENT DOCUMENTS

| | | | | |
|---|---|---|---|---|
| 4,862,429 | | 8/1989 | Rolt | 367/165 |
| 4,901,293 | * | 2/1990 | Kuhn | 367/168 |
| 4,932,008 | | 6/1990 | Rolt | 367/165 |
| 4,941,202 | | 7/1990 | Upton | 367/165 |
| 5,016,228 | * | 5/1991 | Arnold et al. | 367/163 |
| 5,283,835 | * | 2/1994 | Athanas | 381/190 |
| 5,291,461 | * | 3/1994 | Boeglin et al. | 367/163 |
| 5,345,428 | * | 9/1994 | Arnold et al. | 367/165 |
| 5,363,346 | | 11/1994 | Maltby | 367/163 |
| 5,537,481 | * | 7/1996 | Voishvillo et al. | 381/192 |
| 5,959,939 | * | 9/1999 | Tengham et al. | 367/174 |

FOREIGN PATENT DOCUMENTS

| | | | |
|---|---|---|---|
| 95/32601 | 11/1995 | (WO) | H04R/1/44 |
| 96/27863 | 9/1996 | (WO) | G08B/15/00 |

* cited by examiner

*Primary Examiner*—Van T. Trieu
(74) *Attorney, Agent, or Firm*—Dilworth & Barrese, LLP

(57) ABSTRACT

A device for regenerating powerful acoustic pressure comprises at least an arrangement for generating sound while utilizing the flextensional technique, i.e. having at least one surface element (2), the opposite ends (4, 5) of which are arranged to be influenced to oscillate away from and towards each other, and the surface element oscillating transversely thereto and generating sound.

25 Claims, 3 Drawing Sheets

DEVICE FOR GENERATING SOUND

BACKGROUND OF INVENTION

The present invention relates to a device for generating very high sound pressure in air for example to prevent trespass, intrusion or unauthorized staying in an area indoors or outdoors so as to deliver a warning signal calling for attention as a siren.

There are several devices based on different techniques which however have disadvantages as, areas with lower sound pressure low sound pressure at frequencies important for public address low efficiency becomes very large and heavy when very powerful sound pressure is to be achieved

SUMMARY OF THE INVENTION

The object of the present invention is to provide a new device which to a large extent reduces the disadvantages above of already known devices and which also combine a very high sound pressure for a siren function at lower frequencies with a very high sound pressure for frequencies important for the public address function, and also very high sound pressure for even higher frequencies used for example to prevent intrusion or unauthorized staying.

This object is obtained by providing a device comprising at least an arrangement for generating sound while utilizing the flextensional technique, i.e., it has at least one surface element (2), the opposite ends (4,5) of which are arranged to be influenced to oscillate away from and towards each other and the surface element oscillating transversely and generating sound.

By using the flextensional technique in air and within totally new fields and adapting it in accordance with following disclosure can very high sound pressure be achieved within a broad frequency range with advantages as higher efficiency, lower weight, smaller size in comparison with earlier known techniques and devices for these applications.

BRIEF DESCRIPTION OF THE DRAWINGS

The present invention will be described in grater detail with reference to the accompanying drawings, in which.

DESCRIPTION OF THE PREFERRED EMBODIMENTS

Experience has shown that flextensional devices with light membranes adapted to air may give high resonance effects, up to 10 dB or more, and the technique is therefore suitable to be used for sirens. The problem is to achieve a high sound pressure for the siren function in combination with higher sound pressure for the public address function which combination is desired for many applications.

A membrane works for lower frequencies as one unit where the membrane area works in the same direction, called first mode, with a transmission ratio (defined below) depending on the constitution thereof as the thickness, length and bending form. Experience has shown that after this first mode there is a frequency range where the surface element works in a second mode where two areas of the membrane surface work out of phase with the third in (the areas at the ends is out of phase with the mid area). Further up in frequency the surface element totally collapses with a low transmission ratio.

Figure 4:
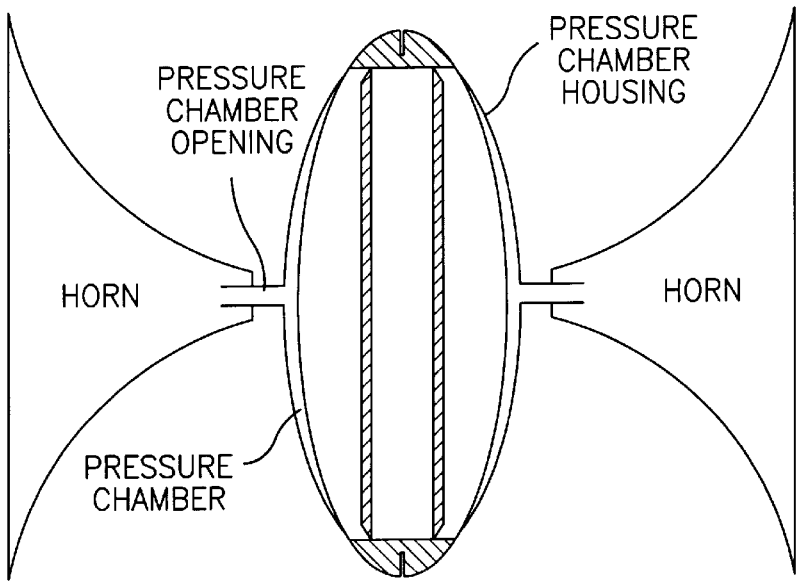
FIG. 4 is sectional view illustrating positioning of horns.

A first main resonance in the first mode of the membranes can be achieved if the driving unit is not made stiff and/or the mass load is made high so that this system resonance occur between driving unit/membrane(s)/horn (FIG. 4). This resonance effect is normally about 4 times. (the stiffness of the driving unit can also be made so high so this resonance will not occur in the first mode).

A device where the stiffness of the driving unit is such that a first main resonance (f1) occurs in the membranes first mode can be characterized by the transmission ratio and by the resonances. The sound pressure will show three specific main maxima when sweeping from lower to higher frequencies with the same current. In the area where the surface element work in the second mode is one maxima called f2.

Experience has shown that this first main resonance frequency for the system (driving unit-membranes) is lowered with an increase of the transmission ratio when the system has a first main resonance in the membranes first mode. This change in the resonance frequency can be described as the transmission factor contribute with the transmission ratio in square multiplied with a fixed mass, giving a total fictive mass (M). The calculated resonance frequency is a function of $1/\sqrt{M}$.

Experience show that by using a high transmission ratio the resonance frequency can easily be lowered without using real masses at the end beams or heavy membranes and also at the same time accordingly achieve a higher acoustic power at a required siren frequency. Experience has also shown that the second mode occurs and a membrane collapses for lower frequencies for membranes with a high transmission ratio.

Preferred is use of a mechanical transformer (FIG. 1 and 1*a*) for a higher transmission ratio which has several advantages. Preferred is a total transmission ratio between 8 to 40 (mechanical transformer and membrane).

By introducing a mechanical transformer (FIGS. 1 and 1*a*) for the above applications, the membrane transformation ratio can be substantially reduced and the membrane can then work at much higher frequencies in the first mode i.e. frequencies very important for the public address and frequencies important to prevent intrusion or unauthorized staying a much higher sound pressure can be achieved at higher frequencies where the element has collapsed, makes it possible to lower the resonance frequency without using a heavy membrane etc. (increase the mass load M) and achieve a first main resonance in the first mode and a high sound pressure for a siren at lower frequencies, larger membranes can be used, which second mode does not occur/or are not collapsing at preferred higher frequencies, for public address etc. and accordingly a higher sound pressure, gives a smoother frequency response.

The mechanical transformer can for example be a lever arm (FIG. 1*a*) and be a part of an end beam. The end beam can be split in two equal sections where each section work as a lever arm and bends over a fulcrum. Fulcrums can be made by introducing two plates, parallel with each membrane, connected to the lever arms (endbeams).

Figure 2:
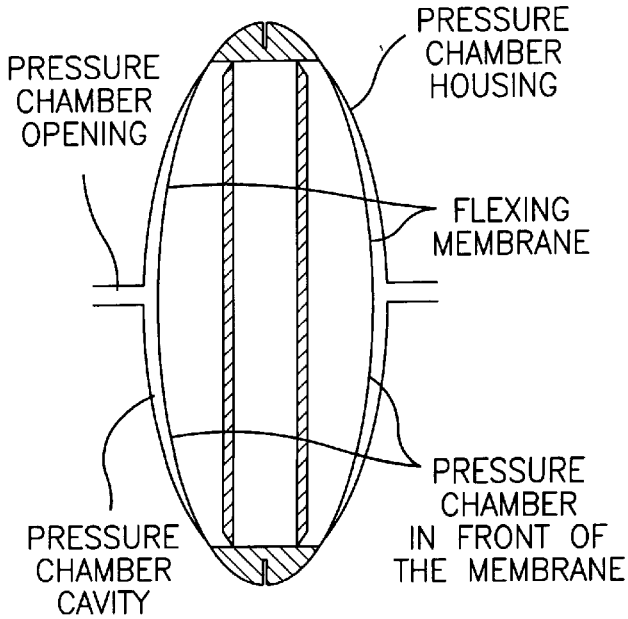
FIG. 2 is a sectional view similar to FIGS. 1 and 1*a* and illustrating the air transformer and/or pressure chamber in accordance with the present invention.
Figure 3:
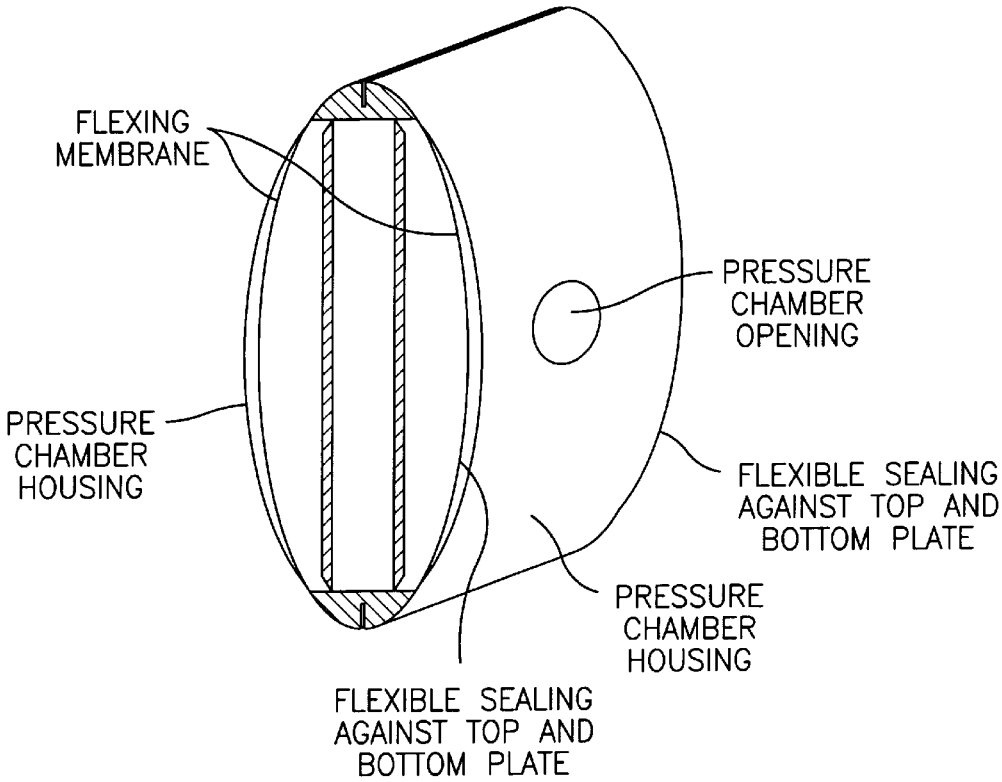
FIG. 3 is perspective view of FIG. 2.

Preferred is also for example, as a siren, to combine a mechanical transformer, a membrane working in its first mode for frequencies essential for public address 800–1500 Hz with an air transformer and/or pressure chamber (FIGS. 2 and 3) with a horn (FIG. 4). The mechanical transformer make it possible to use a membrane that does not break up into a second mode which will dramatically reduce the acoustical output power essential for the siren and public address function especially when used together with above air chamber/horn loading. Preferred is also to have the first main resonance in the area essential for public address 800–1500 Hz.

Experience has also shown that the resonance effect (the end beam movement divided with the calculated driving unit movement) and sound pressure shows a maxima for frequencies above f2 when the membrane has collapsed with a very low transmission factor. This resonance effect is about 6 to 8 times.

The transmission factor of the device is defined, when two opposite ends are driven, as the quotient of the amplitude of the maximum oscillation of the membrane and the amplitude of any end thereof and/or the total amplitude of the total driving unit movement divided by 2. The transmission ratio has shown at lower frequencies to be relatively constant and at a point increase at higher frequencies and with a high transformation ratio before entering into the second mode.

Figure 5A:
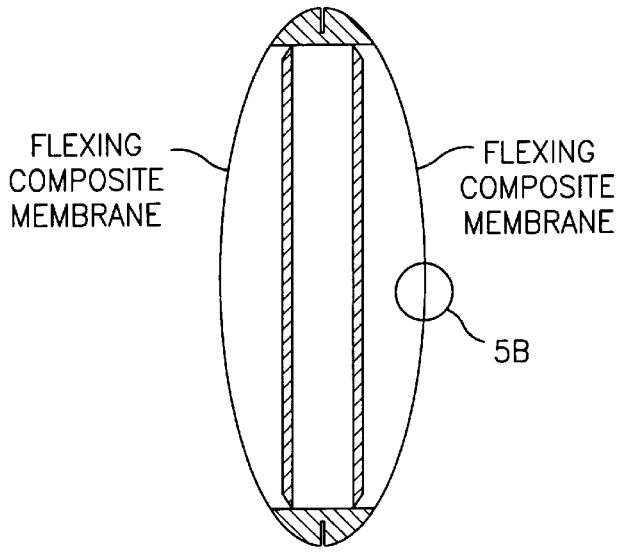
FIGS. 5*a*, 5*b* are respective sectional views, with FIG. 5(*b*) illustrating a cross-section of a membrane formed by two first layers and an intermediate thicker layer.
Figure 5B:
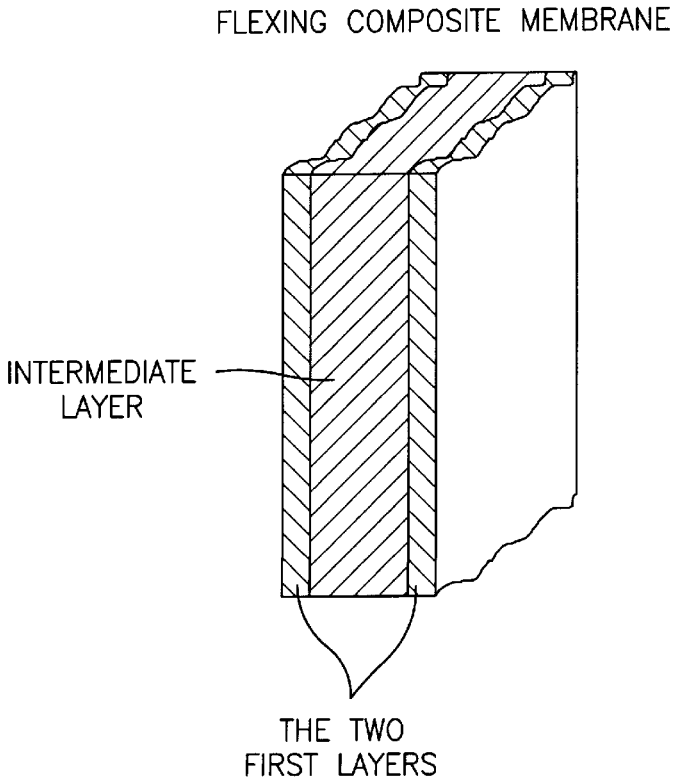

Another preferred embodiment of the invention is that said surface element has a high stiffness with respect to the average density thereof by incorporating material portions therein having a lower density than the rest of the surface element or by arranging cavities therein. It is by this possible to obtain a light but nevertheless stiff surface element. This may for instance be done in any of the ways described in PCT/SE/95/00571 or PCT SE/95/01113. A portion of the surface element may be formed by at least two first layers and an intermediate (FIGS. 5*a*, and 5*b*) having a lower density than the density of any of the first two layers as seen in the thickness direction thereof. The first layers may for example be made of carbon fiber baked into a matrix with a density of about 1500 kg/m3. The intermediate layer may be of cellular plastic or honey comb structure with a density of about 300 kg/m3.

The above designs is also suited for Public Address systems (PA). The invention also include end driven flextensional devices.

REFERENCE NUMERALS IN

Figure 1:
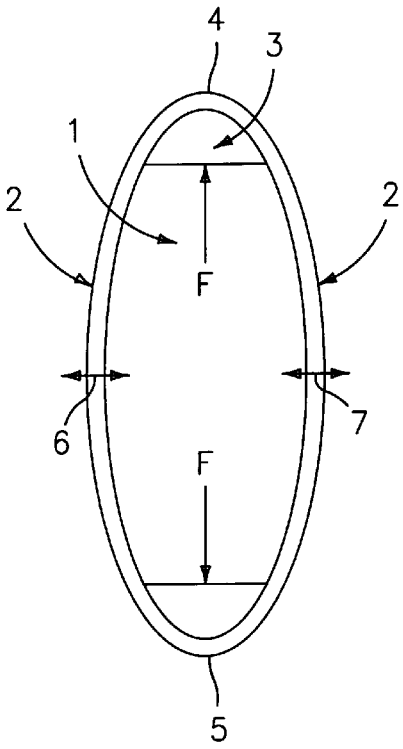
FIG. 1 is a simplified sectional view of a flextensional sound generator in accordance with the present invention.
Figure 1A:
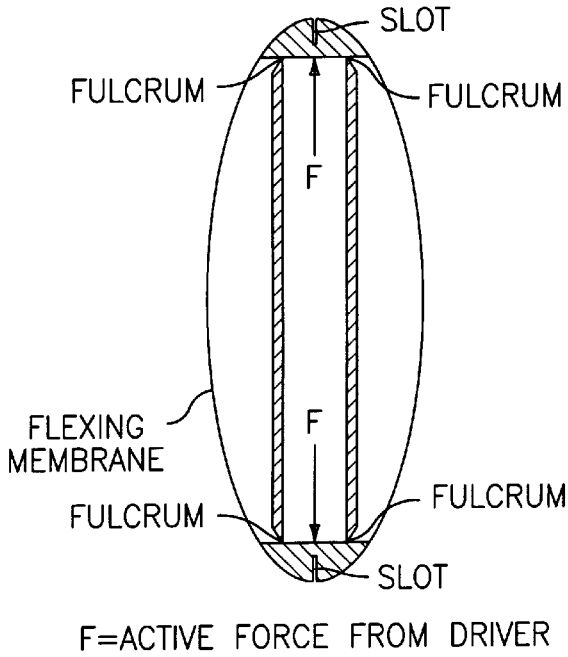
FIG. 1*a* is a more detailed sectional view illustrating the mechanical transformer lever mechanism formed by the fulcrum in accordance with the present invention.

FIG. 1, a simplified sectional view of a flextensional sound generator:

DESCRIPTION OF THE PREFERRED EMBODIMENT

Referring to FIG. 1, the reference numerals denote the following elements:

1. force from driving unit

2. membranes

3. endbeams

4,5 flextensional ends

6,7 membrane movement

What is claimed is:

1. A device for generating powerful acoustic pressure in air comprising at least an arrangement for generating sound while utilizing a flextensional technique, having at least one surface element or membrane (2) opposite ends (4,5) of which are arranged to be influenced to oscillate away from and towards each other and by the surface element oscillating transversely thereto and generating sound, said surface element being light but nevertheless stiff by having a high stiffness with respect to the average density thereof, said membrane being coupled to an air transformer and/or pressure chamber for generating powerful acoustic pressure.

2. A device according to claim 1 characterized in that it comprises a mechanical transformer/lever mechanism.

3. A device according to claim 2, characterized in that the membrane works in the first mode for frequencies used for public address.

4. A device according to claim 2, characterized in that a membrane where at least one portion thereof is formed in the thickness direction thereof by at least two first layers and an intermediate layer having a lower average density than the density of the two first layers.

5. A device according to claim 2, characterized in that said surface element (2) has a high stiffness with respect to the average density thereof, so that a light but nevertheless stiff surface element is obtained.

6. A device according to claim 2, wherein said mechanical transformer is a lever arm and part of an end beam which is split in two equal sections, with each section operating as a lever arm and bending over a fulcrum which is formed by introducing two plates, parallel with each membrane, connected to said lever arms (end beams).

7. A device according to claim 1 characterized in that the membrane works in the first mode for frequencies used for public address.

8. A device according to claim 7, characterized in that a membrane where at least one portion thereof is formed in the thickness direction thereof by at least two first layers and an intermediate layer having a lower average density than the density of the two first layers.

9. A device according to claim 7, characterized in that said surface element (2) has a high stiffness with respect to the average density thereof, so that a light but nevertheless stiff surface element is obtained.

10. A device according to claim 1 characterized in that the membrane is coupled directly or indirectly to a horn.

11. A device according to claim 10, characterized in that a membrane where at least one portion thereof is formed in the thickness direction thereof by at least two first layers and an intermediate layer having a lower average density than the density of the two first layers.

12. A device according to claim 10, characterized in that said surface element (2) has a high stiffness with respect to the average density thereof, so that a light but nevertheless stiff surface element is obtained.

13. A device according to claim 5, wherein, as said siren, said mechanical transformer is combined with said membrane operating in its first mode for frequencies essential for public address 800–1500 Hz with it being possible to use said membrane which does not break up into a second mode which would dramatically reduce acoustical output power essential for said siren and a public address function.

14. A device according to claim 13, having a first main resonance in an area essential for public address of 800–1500 Hz.

15. A device according to claim 1 characterized in that the first main resonance is placed in the first mode of the membrane.

16. A device according to claim 15, characterized in that a membrane where at least one portion thereof is formed in the thickness direction thereof by at least two first layers and an intermediate layer having a lower average density than the density of the two first layers.

17. A device according to claim 15, characterized in that said surface element (2) has a high stiffness with respect to the average density thereof, so that a light but nevertheless stiff surface element is obtained.

18. A device according to claim 6, wherein said mechanical transformer is structured and arranged for a high transmission ratio of between 8 to 40 (mechanical transformer and membrane).

19. A device according to claim 18, structured and arranged such that resonance effect, an end of beam movement divided with a calculated driving unit movement and sound pressure exhibit a maximum of frequencies above f2 when said membrane has collapsed with a very low transmission factor, and a resonance effect about 6 to 8 times.

20. A device according to claim 1 characterized in a membrane where at least one portion thereof is formed in the thickness direction thereof by at least two first layers and an intermediate layer having a lower average density than the density of the two first layers.

21. A device according to claim 20, wherein said first two layers is manufactured of carbon fiber baked into a matrix with a density of about 1500 kg/m3, and said intermediate layer are formed of cellular plastic or honeycomb structure having a density of about 300 kg/m3.

22. A device according to claim 1 characterized in that it is structured and arranged for use for siren applications and/or to prevent intrusion or unauthorised staying in an area or Public Address System(PA).

23. A device according to claim 1, structured and arranged to generate sound in air.

24. A device according to claim 1, structured and arranged to combine very high sound pressure for a siren function at lower frequencies with very high sound pressure for frequencies significant for a public address function, and also high sound pressure for even higher frequencies used to prevent intrusion or unauthorized loitering.

25. A device according to claim 1, wherein said surface element possesses a high stiffness with respect to average density thereof by incorporating material portions therein having a lower density than a remainder of said surface element or by arranging cavities therein.

* * * * *